US010125457B1

(12) United States Patent
Yin et al.

(10) Patent No.: US 10,125,457 B1
(45) Date of Patent: Nov. 13, 2018

(54) METHOD OF PAVING ABNORMAL-SHAPED GRID DECKS

(71) Applicant: RUENTEX ENGINEERING & CONSTRUCTION CO., LTD., Taipei (TW)

(72) Inventors: Samuel Yin, Taipei (TW); Chang-Sheng Tsao, Taipei (TW)

(73) Assignee: RUENTEX ENGINEERING & CONSTRUCTION CO., LTD., Taipei (TW)

( * ) Notice: Subject to any disclaimer, the term of this patent is extended or adjusted under 35 U.S.C. 154(b) by 0 days.

(21) Appl. No.: 15/798,519

(22) Filed: Oct. 31, 2017

(30) Foreign Application Priority Data

Sep. 7, 2017 (TW) ..... 106130575 A

(51) Int. Cl.
*E01D 19/12* (2006.01)
*E01C 11/16* (2006.01)
*E04B 5/04* (2006.01)

(52) U.S. Cl.
CPC ..... *E01C 11/16* (2013.01); *E01D 19/125* (2013.01); *E04B 5/04* (2013.01)

(58) Field of Classification Search
CPC ... E01D 19/12; E01D 19/125; E01D 2101/00; E04B 5/023; E04B 5/026; E04B 5/04
USPC ..... 14/73, 77.1; 52/610
See application file for complete search history.

(56) References Cited

U.S. PATENT DOCUMENTS 400,974 A * 4/1889 Thorn ..... E04B 2/22 52/610
7,520,014 B2 * 4/2009 Homsi ..... E01D 19/103 14/77.1
7,665,255 B2 * 2/2010 Dressendorfer ..... H02G 3/0456 108/50.02
7,669,272 B2 * 3/2010 Powers ..... E01D 21/06 14/77.1
8,656,543 B2 * 2/2014 Porter ..... E04G 11/48 14/77.1
8,671,634 B2 * 3/2014 Morcous ..... E04B 5/16 52/252
9,151,063 B2 * 10/2015 McManus ..... E04F 15/02044
2014/0041328 A1 * 2/2014 Stehle ..... E04B 5/023 52/250
2018/0002915 A1 * 1/2018 De Visscher ..... E04B 1/3431

* cited by examiner

*Primary Examiner* — Gary S Hartmann
(74) *Attorney, Agent, or Firm* — Juan Carlos A. Marquez; Marquez IP Law Office, PLLC

(57) ABSTRACT

In a method of laying out abnormally-shaped grid decks, the abnormally-shaped grid decks refer to grid decks having a cut-out at the corner thereof. It is usually a problem when laying out abnormally-shaped grid decks because they will be off-balance when they are laid on the columns. Support frames are used to support the abnormally-shaped grid decks and keep them balanced and stable on the columns. However, the support frames may obstruct the working route used in construction. The method adopted in the present invention adds temporary beams to maintain the abnormally-shaped grid decks by balancing them on the columns before they are fixed and secured thereon, and thereafter the temporary beams will be removed. This method can prevent using support frames which may obstruct the working route under construction.

6 Claims, 5 Drawing Sheets

METHOD OF PAVING ABNORMAL-SHAPED GRID DECKS

TECHNICAL FIELD

This invention is directed to the method, of paving abnormal-shaped grid decks.

BACKGROUND

In the construction techniques, a pre-casting method is usually adopted in order to save construction time. In the pre-casting method, the components, such as beams, columns, and decks, are pre-casted off the construction site and are then transported to the construction site for subsequent assembling and grouting. Accordingly, the space at the construction site would be less taken up and support frames used for construction would be greatly reduced. Therefore, the working flow line would be much better. The on-site construction time would be significantly reduced. Since the beams, columns, and decks are produced in the workshop, away from the construction site, the production rate, precision and quality thereof can easily be monitored and reach the expected level. Accordingly, the pre-casting method has become the mainstream for the current construction technology.

Grid decks are widely used in the construction of plants, particularly, those for a wafer factory. Grid decks can be produced on-site through grouting or in a pre-casting workshop. The grid decks contain rebar, which reinforces the strength thereof. The grid decks also have hollow portions for equipment hook-up, which also effectively reduce the weight thereof.

When building a plant, the pre-cast grid decks are laid over the pre-cast columns in a suitable span so that on-site construction is simplified, and thus the construction time is significantly reduced.

The pre-cast grid decks have an embedded connecting rebar that protrudes laterally. Grid decks are laid on I-beams with gaps therebetween and grout is filled into the gaps. The grid decks will be connected to each other and fixed after the grout is cured.

On some occasions, the grid decks are not normally rectangular. For example, there can be a cut-out at one of the corners of the grid decks. Such grid decks are called "abnormal-shaped, grid decks." The use of abnormal-shaped grid decks can be found where there is a need to lay out staircase. A grid deck under such condition is cut out a portion, which is usually at one corner of the grid deck. With the portion cut out, the grid deck may not be supported in balance, and therefore cannot be fixed on the top of the columns. Accordingly, there is a need to set up additional support frames to support the abnormal-shaped grid deck. However, the additional support frames would occupy a substantial space at the construction site and cause inconvenience to the workers during construction. Accordingly, there is a need to improve the existing method of paving abnormal-shaped grid decks.

SUMMARY OF INVENTION

The objective of the present invention is to overcome the problem in paving abnormal-shaped grid decks. When paving grid decks, they are laid on the top of the columns. The grid decks are supported by four columns at the four corners thereof, respectively, and thus they can be kept in balance to be subsequently fixed on the columns. However, abnormal-shaped grid decks, in which a portion is cut out, can be supported only at no more than three corners. Only three points being supported, may not sufficiently keep the grid deck in balance, and thus the abnormal-shaped grid deck cannot be fixed on the columns. The present invention provides measures of keeping abnormal-shaped grid decks in balance before they are fixed on the top of columns, and after the abnormal-shaped grid decks are fixed on the top of columns, the measures are removed. Embodiments with these measures are provided and described in the following Detailed Description.

DETAILED DESCRIPTION

Figure 1:
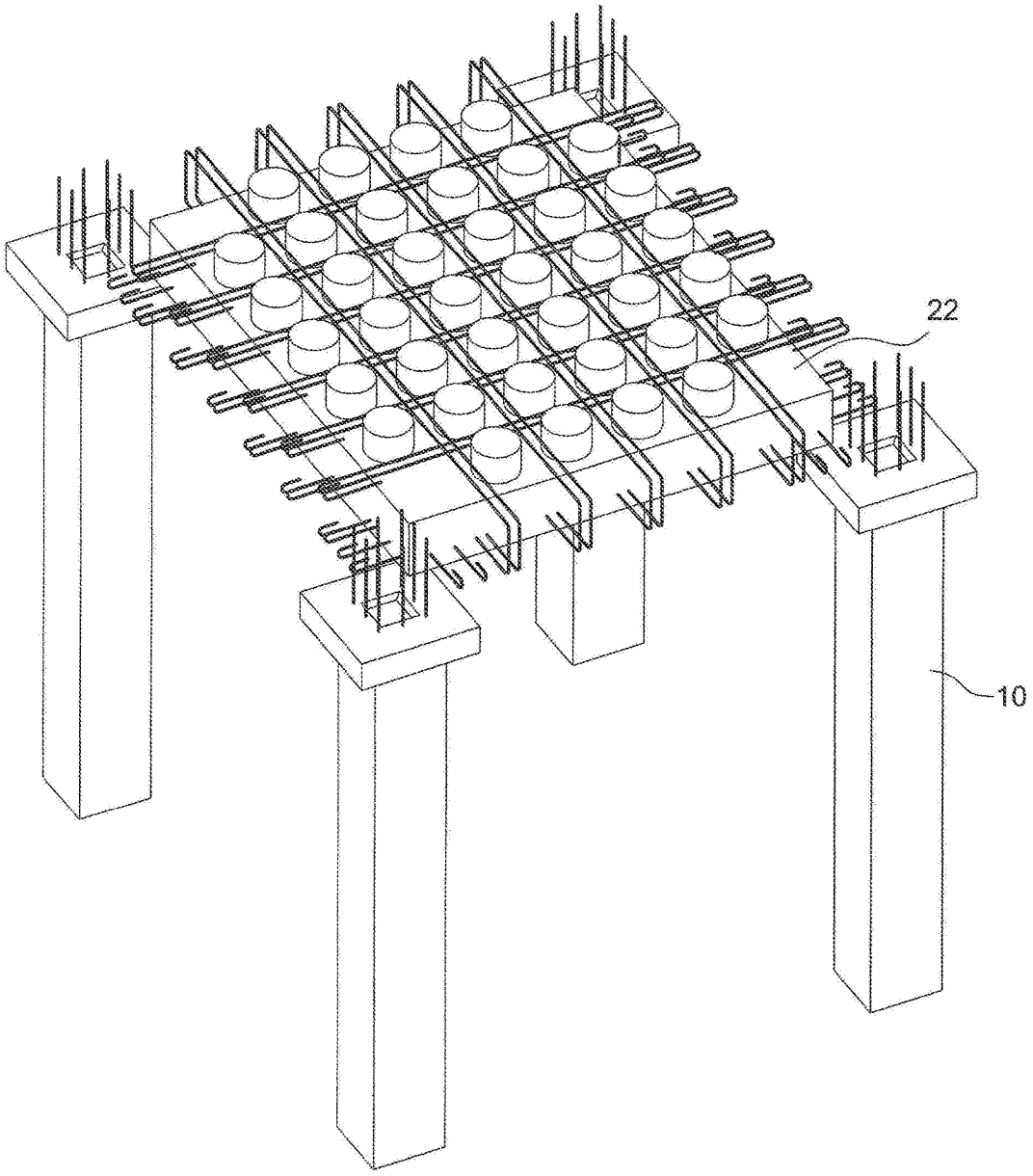
PRIOR ART FIG. 1
FIG. 1 shows a normal grid deck laid on columns.

The method of paving normal grid decks on columns is shown in FIG. 1, where the four corners of the grid deck 22 are supported by four columns 10, respectively. It is generally unnecessary to worry about whether there is any imbalance in paving normal grid decks.

Figure 2:
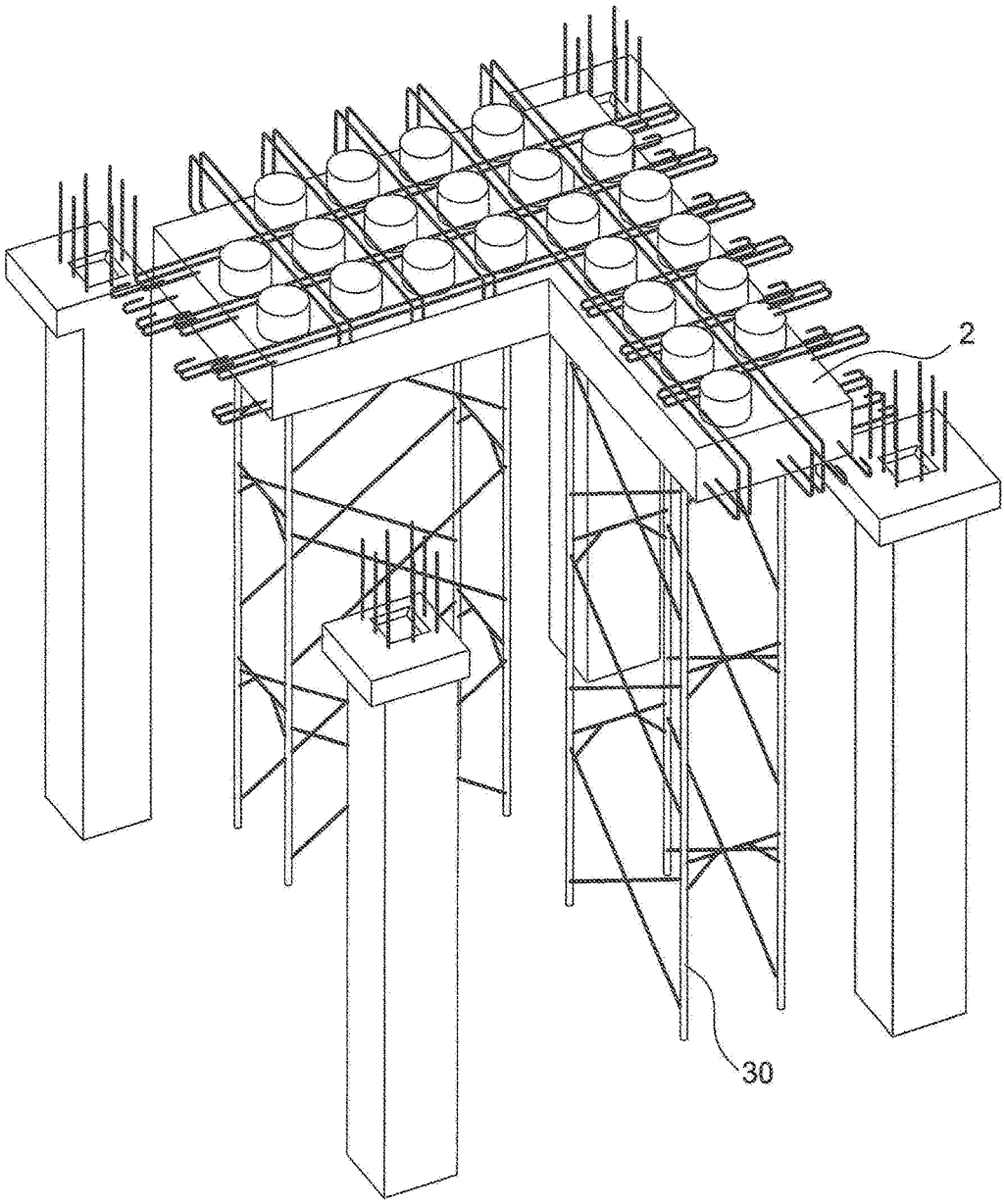
FIG. 2 shows a method commonly adopted in paving an abnormal-shaped grid deck on columns.

FIG. 2 shows a commonly adopted method of paving abnormal-shaped grid decks. Compared with paving normal grid decks, balance problems need to be overcome when paving abnormal-shaped grid decks. When paving abnormal-shaped grid decks 2, it is necessary to install support frames 30 to keep the abnormal-shaped grid decks 2 in balance. However, support frames would occupy much space and obstruct the working flow line and cause an inconvenience to the workers.

Figure 3:
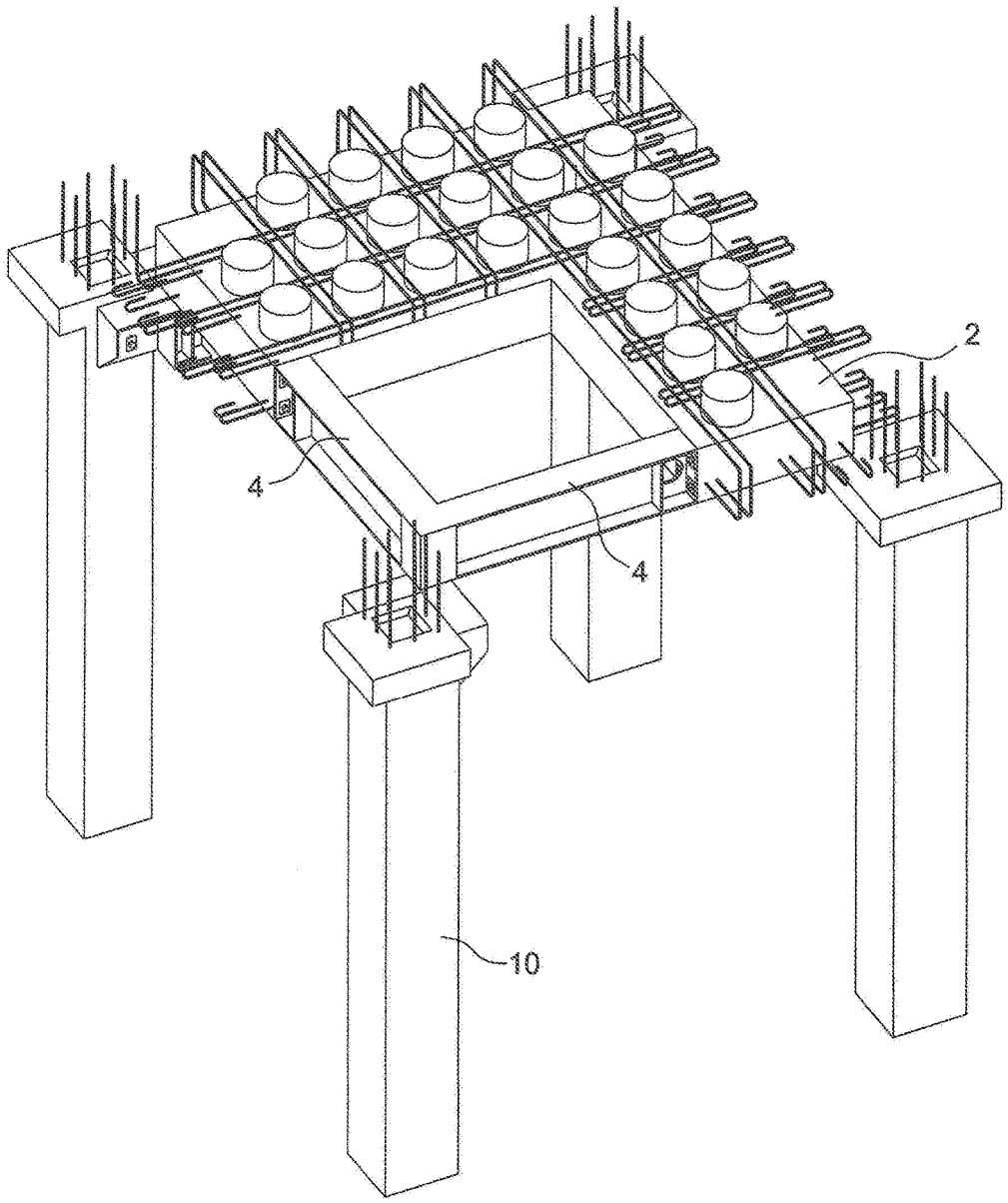
FIG. 3 shows temporary beams, are applied to an abnormal-shaped grid deck in an embodiment of the present invention.
Figure 4:
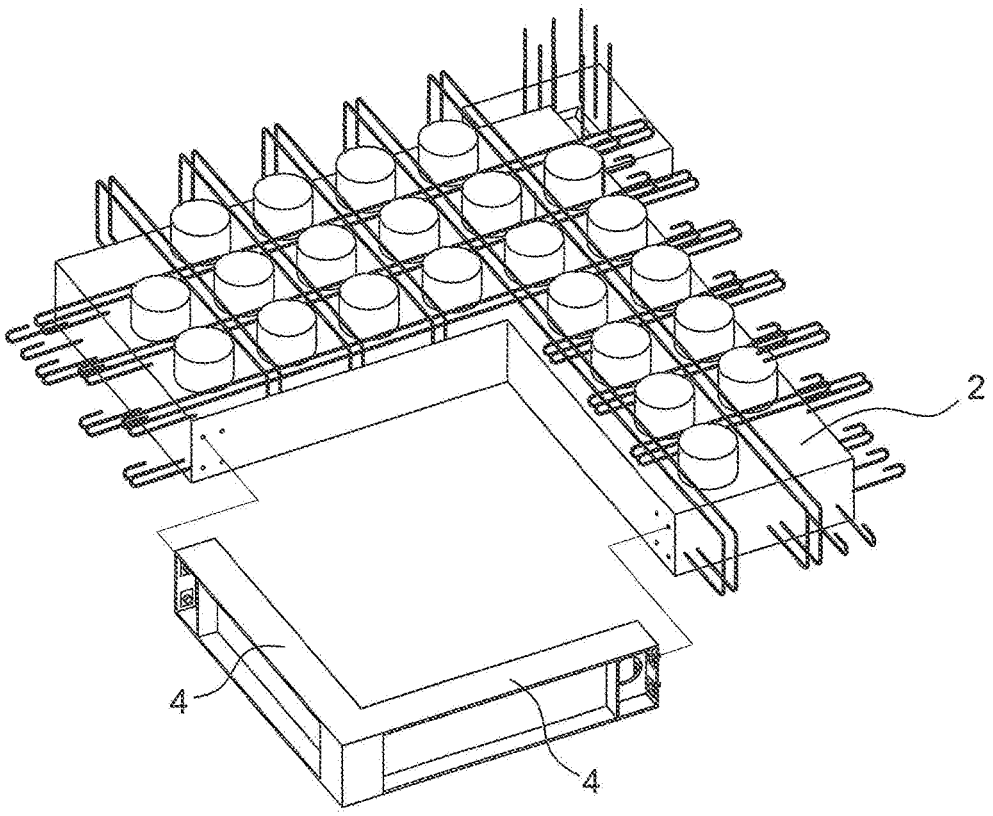
FIG. 4 shows a grid deck and the temporary beams.

FIG. 3 shows a method of laying an abnormal-shaped grid deck on the columns disclosed by the present invention. FIG. 4 illustrates only the abnormal-shaped grid deck 2 and the temporary beams 4 shown in FIG. 3. Comparing the abnormal-shaped grid deck shown in FIG. 2, this abnormal-shaped grid deck 2 has additional beams 4. The two additional beams enable the abnormal-shaped grid deck 2 having a cut-out portion as shown in FIG. 2 to have a complete rectangular profile as shown in FIG. 4. Thus, the abnormal-shaped grid deck 2 can be paved as a normal grid deck. Paving the abnormal-shaped grid decks in this method comprises the following steps:

(1) adding temporary beams to a cut-out of the abnormal-shaped grid decks to complete the rectangular profile thereof;

(2) lifting the abnormal-shaped grid decks to lay them on the top of the already erected column;

(3) securing the abnormal-shaped grid decks on the top of the column; and (4) removing the temporary beams from the abnormal-shaped grid decks.

Figure 5:
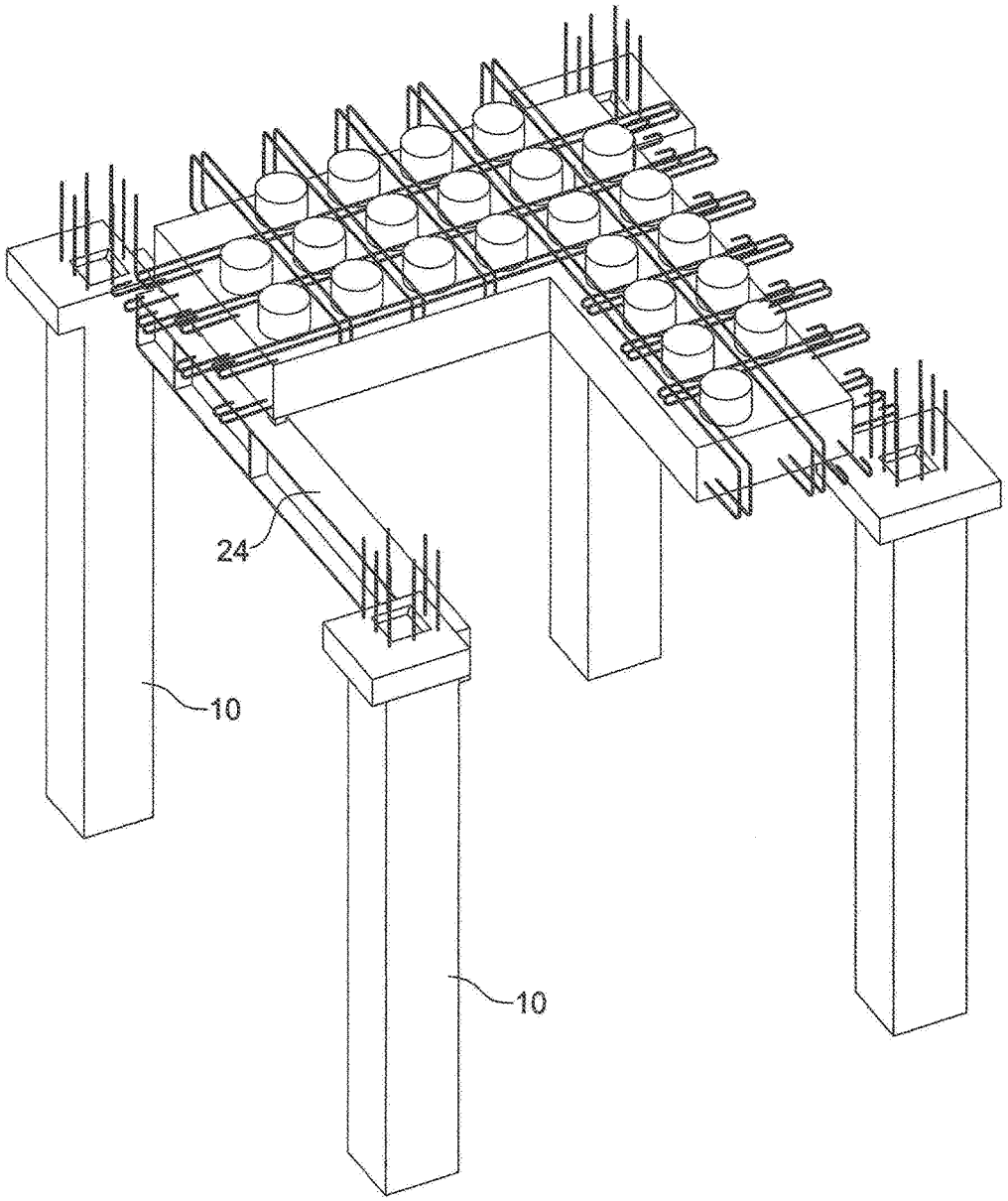
FIG. 5 shows another embodiment of the present invention in which a temporary beam is applied to the columns.

FIG. 5 shows another embodiment of the present, invention, in which a beam 24 with its two ends respectively attached to two columns 10. If necessary, another beam may be attached to two other columns so that the abnormal shaped grid deck 2 laid on top of the columns would keep in balance. In this embodiment, paving abnormal-shaped grid decks comprises the following steps:

(1) adding temporary beams to the top of the already erected column;

(2) lifting the abnormal-shaped grid decks to lay them on top of the column;

(3) securing the abnormal-shaped grid decks on the top of the column; and (4) removing the temporary beams from the abnormal-shaped grid decks.

From the foregoing, it will be appreciated that, although specific embodiments of the invention have been described herein for purposes of illustration, various modifications may be made without departing from the spirit and scope of the embodiments described herein.

What is claimed is:

1. A construction method comprising the steps of:

providing four erected columns on a ground, the positions of the four erected columns being arranged in a rectangular shape;

providing a grid deck in a non-rectangular shape, the grid deck having a plurality of cylindrical molds therein, and a plurality of reinforcement cages being provided between the plurality of cylindrical molds, and wherein the non-rectangular shape has a cut-out;

adding a temporary structure to the cut-out of the non-rectangular shape of the grid deck, so as to form a rectangular structure;

lifting the rectangular structure and laying it on tops of the four erected columns;

securing the grid deck of the rectangular structure to the tops of the four erected columns; and removing the temporary structure of the rectangular structure from the grid deck; wherein the rectangular structure provides balance to the step of lifting.

2. The method of claim 1 wherein the step of providing a grid deck in a non-rectangular shape is providing an L-shaped grid deck.

3. The method of claim 2 wherein the step of adding a temporary structure to the cut-out of the non-rectangular shape of the grid deck is adding an L-shaped temporary structure formed of a first beam perpendicularly connected to a second beam to the cut-out of the non-rectangular shape of the grid deck.

4. The method of claim 3 wherein the step of adding an L-shaped temporary structure formed of a first beam perpendicularly connected to a second beam to the cut-out of the non-rectangular shape of the grid deck includes securing two ends of the L-shaped temporary structure to the grid deck, so as to form the rectangular structure.

5. The method of claim 3 wherein the grid deck is a pre-cast grid and is to be installed in a wafer factory.

6. The method of claim 3 wherein the two ends of the L-shaped temporary structure is respectively a free end of the first beam and a free end of the second beam.

* * * * *